US006625414B2

(12) United States Patent
Izumi

(10) Patent No.: US 6,625,414 B2
(45) Date of Patent: Sep. 23, 2003

(54) IMAGE FORMING APPARATUS WITH RECOVERY DEVICE FOR RECOVERING COLOR DEVELOPERS

(75) Inventor: Takao Izumi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/059,208

(22) Filed: Jan. 31, 2002

(65) Prior Publication Data

US 2003/0142997 A1 Jul. 31, 2003

(51) Int. Cl.[7] ..... G03G 15/01; G03G 21/10

(52) U.S. Cl. ..... 399/227; 399/298; 399/302; 399/358; 399/359

(58) Field of Search ..... 399/149, 150, 399/226–228, 298, 302, 358–360

(56) References Cited

U.S. PATENT DOCUMENTS 4,707,108 A * 11/1987 Ohno ..... 399/227
5,442,430 A * 8/1995 Ishii et al. ..... 399/359 X
5,765,087 A * 6/1998 Yano et al. ..... 399/358 X
6,337,967 B1 1/2002 Izumi et al. ..... 399/297

FOREIGN PATENT DOCUMENTS

| | | |
|---|---|---|
| JP | 5-19662 | 1/1993 |
| JP | 9-23696 | 1/1997 |
| JP | 9-96939 | 4/1997 |

* cited by examiner

*Primary Examiner*—William J. Royer
(74) *Attorney, Agent, or Firm*—Foley & Lardner

(57) ABSTRACT

An image forming apparatus includes developing units of a plurality of colors, at a developing position, to develop electrostatic latent images, a rotation member for retaining the developing units of the plurality of colors along a rotating direction, and rotating to sequentially move the developing units to the developing position, an intermediate transfer member for sequentially superposing and transferring the developer images formed on an image carrier, and transferring the superposed and transferred developer images together to an image-transferred member, and a plurality of recovery devices retained on the rotation member, between the developing units of the plurality of colors, for recovering developers after the transfer of the developer images to the intermediate transfer member, and making the recovered developers return to the developing units of the same colors as the colors of the developers.

11 Claims, 8 Drawing Sheets

IMAGE FORMING APPARATUS WITH RECOVERY DEVICE FOR RECOVERING COLOR DEVELOPERS

BACKGROUND OF THE INVENTION

The present invention relates to an image forming apparatus available as, for example, an electrophotographic copying machine.

Recently, opportunity of use of color images has been increased in offices, and electrophotographic color image forming apparatuses, particularly, color printers and color MFP, have been installed in offices. In many offices and the like that are large to some extent, a black-and-white copying machine is used together with a color printer. However, as color printers penetrate into smaller offices, the color MFP are required in place of the black-and-white copying machines.

In this case, it is desired that the color MFP should have the same performance of black-and-white copying as a black-and-white copying machine and should be capable of color printing. At present, a method of the most widespread method color image forming apparatuses is a method using an intermediate transfer member. In this method, an image of each color is developed on a photosensitive member, the developed images are sequentially transferred on the intermediate transfer member such that the images of four colors are superposed thereon, and the images are transferred together on paper.

One of the developing methods in the color image forming apparatuses is disclosed in, for example, Jpn. Pat. Appln. KOKAI Publication No. 60-214377. According to this method, a plurality of development units for respective colors are collectively arranged in an approximately columnar shape on a rotation member, and the development units are sequentially made to be opposite to the photosensitive member for development by rotating the rotation member.

As for a monochrome printing apparatus, a cleaner-less system emitting no waste toner has been noticed from the viewpoint of environmental friendliness. In this cleaner-less system, when a photosensitive member turns at one time and returns to a development position, residual toner on the photosensitive member generated when a toner image is transferred from the photosensitive member to an image-transferred member, is recovered at a developer unit.

However, the following problem arises in a case where the cleaner-less technique for the monochrome printing apparatus is applied to the above-mentioned color image forming apparatus. For example, when an yellow toner image is transferred from the photosensitive member to the intermediate transfer member, yellow transfer residual toner is generated on the photosensitive member. In the color image forming apparatus, however, an yellow developer unit is changed to a magenta developer unit while the transfer residual toner is moved to the development position by the rotation of the photosensitive member. For this reason, the yellow transfer residual toner on the photosensitive member is recovered by the magenta developer unit and the magenta toner and the yellow toner are mixed.

To solve this problem, a measure of employing a recovery device wherein a plurality of recovery units for recovering the transfer residual toner are arranged around the photosensitive member or a plurality of recovery units are collectively arranged in an approximately columnar shape on a rotary member, and the recovery units are sequentially made to face the photosensitive member by the rotation of the rotary member to recover the residual toner, as disclosed in Jpn. Pat. Appln. KOKAI Publication No. 9-23696, is proposed.

In this case, however, the recovered toner cannot be reused, or the apparatus becomes large such that the manufacturing costs are increased.

BRIEF SUMMARY OF THE INVENTION

The present invention has been accomplished in consideration of the above-described circumstances, and the object of the present invention is to provide an image forming apparatus capable of recovering residual toner without upsizing and of reusing the recovered toner.

An image forming apparatus according to the present invention comprises an image forming device which separates image information into a plurality of color information items, which scans information light on a rotating image carrier for exposure in accordance with the separated color information items, and which sequentially forms electrostatic latent images of respective colors, developing units of a plurality of colors, which sequentially feed developers of the respective colors to the electrostatic latent images of the respective colors formed by the image forming device, at a developing position, to develop the electrostatic latent images, a rotation member which retains the developing units of the plurality of colors along a rotating direction, and which rotates to sequentially move the developing units to the developing position, an intermediate transfer member which sequentially superposes and transferring the developer images formed on the image carrier, and which transfers the superposed and transferred developer images together to an image-transferred member, and a plurality of recovery devices retained on the rotation member, between the developing units of the plurality of colors, for recovery of developers after the transfer of the developer images to the intermediate transfer member, and to make the recovered developers return to the developing units of the same colors as the colors of the developers.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be described below in detail with reference to the drawings.

Figure 1:
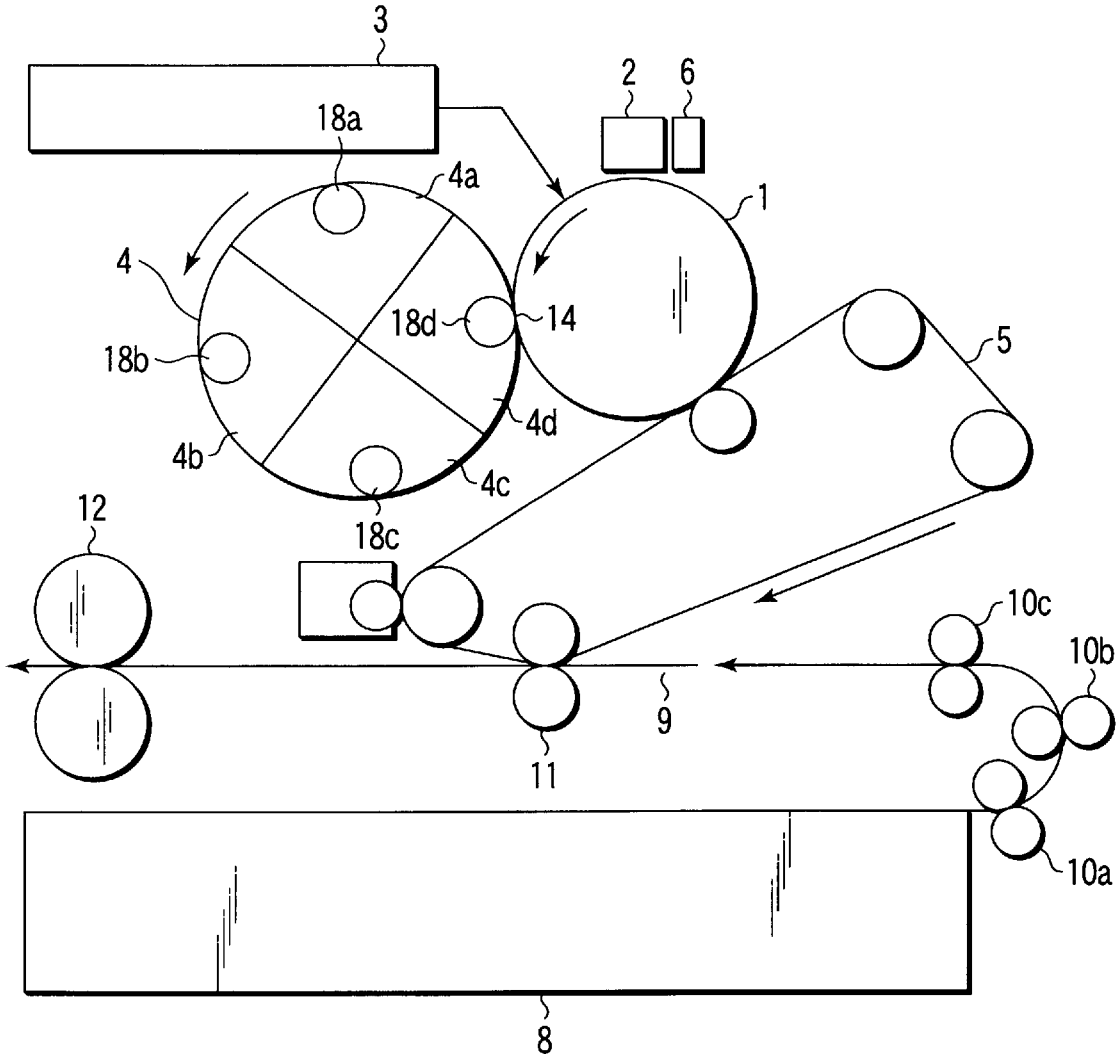
FIG. 1 shows a schematic view of an electrographic copying machine according to a first embodiment of the present invention.

FIG. 1 is a diagram showing a color image forming apparatus using an electrophotographic process according to an embodiment of the present invention.

Reference numeral 1 denotes a photosensitive drum which is provided to be freely rotatable and serves as an image carrier. On the periphery of the photosensitive drum 1, an electrifier 2, an exposure device 3 serving as an image forming device, a developing device 4, an intermediate transfer belt 5 serving as an intermediate transfer member, and a destaticizer 6 are arranged in order along a direction of rotation of the photosensitive drum 1.

A paper feed cassette 8 is provided below the intermediate transfer belt 5, and paper which is taken out of the paper feed cassette 8 and which serves as an image-transferred member is conveyed along a conveyance path 9. Conveyance roller pairs 10*a* to 10*c*, transfer rollers 11 and fixing rollers 12 are provided in order along a direction of conveyance of the paper, in the conveyance path 9.

Figure 2:
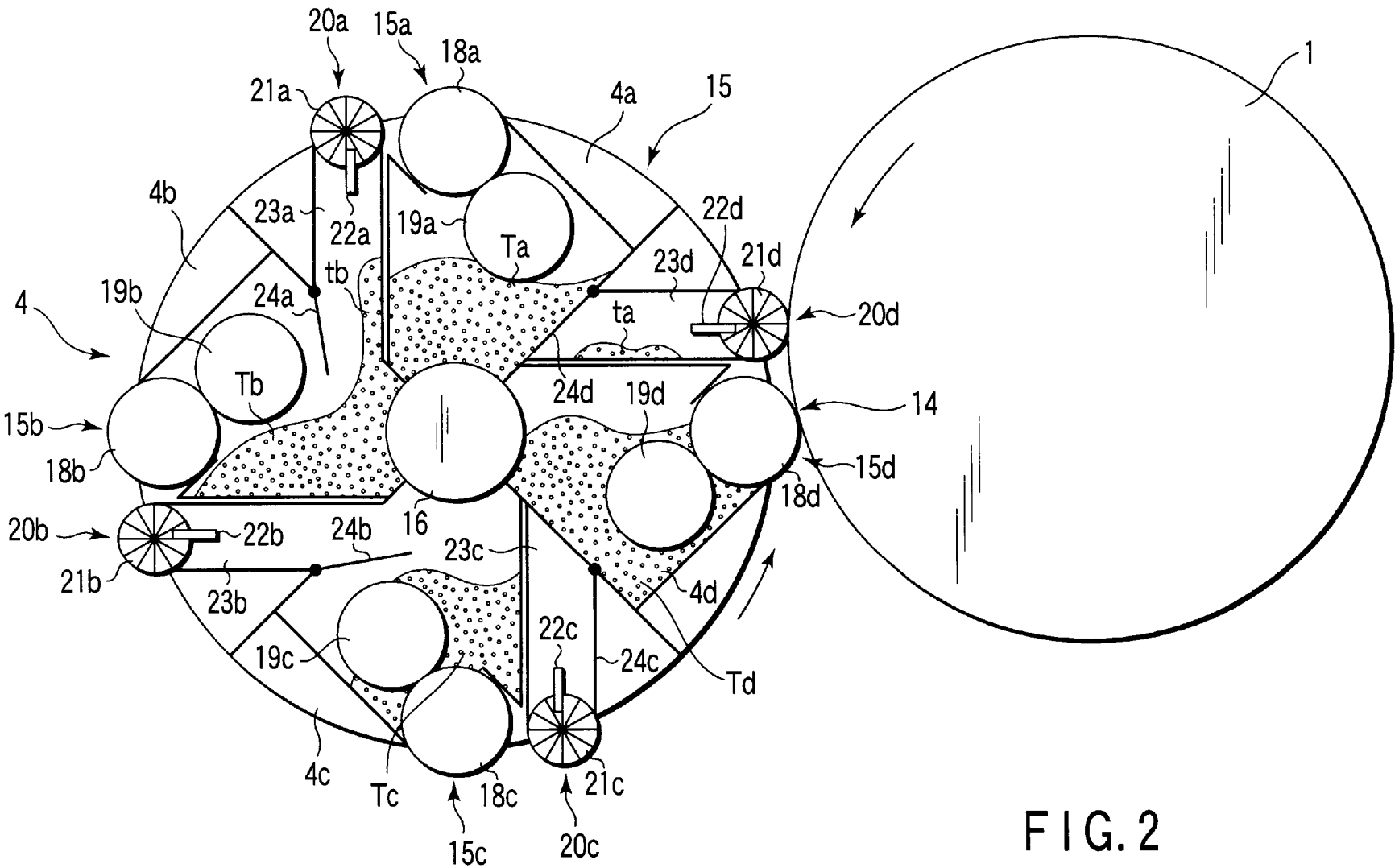
FIG. 2 shows a photosensitive drum and a developing device.

FIG. 2 is an enlarged view of the photosensitive drum 1 and the developing device 4.

The developing device 4 is a revolver type and comprises a retaining member 15 as a rotation member, which is freely rotatable. The retaining member 15 is divided into first to fourth blocks 15*a* to 15*d* along a direction of rotation. The retaining member 15 is rotated in a counterclockwise direction by a revolver rotation driving portion 16.

A BK developing unit 4*a* is retained in the first block 15*a* of the retaining member 15, ha C developing unit 4*b* is retained in the second block 15*b*, an M developing unit 4*c* is retained in the third block 15*c*, and a Y developing unit 4*d* is retained in the fourth block 15*d*.

In the BK developing unit 4*a*, black toner Ta which is nonmagnetic one-component toner is contained, and a feed roller 19*a* for feeding the black toner Ta and a developing roller 18*a* for feeding the black toner Ta fed by the feed roller 19*a* to the photosensitive drum 1 are arranged.

In the C developing unit 4*b*, cyan toner Tb which is nonmagnetic one-component toner is contained, and a feed roller 19*b* for feeding the cyan toner Tb and a developing roller 18*b* for feeding the cyan toner Tb fed by the feed roller 19*b* to the photosensitive drum 1 are arranged.

In the M developing unit 4*c*, magenta toner Tc which is nonmagnetic one-component toner is contained, and a feed roller 19*c* for feeding the magenta toner Tc and a developing roller 18*c* for feeding the magenta toner Tc fed by the feed roller 19*c* to the photosensitive drum 1 are arranged.

In the Y developing unit 4*d*, yellow toner Td which is nonmagnetic one-component toner is contained, and a feed roller 19*d* for feeding the yellow toner Td and a developing roller 18*d* for feeding the yellow toner Td fed by the feed roller 19*d* to the photosensitive drum 1 are arranged.

In the developing units 4*a* to 4*d*, a layer forming member (not shown) for restricting a thickness of a toner layer on the respective developing rollers 4*a* to 4*d* to a constant thickness and electrifying the toner is arranged. A chip is applied to an end of a leaf spring of phosphor bronze as a layer restricting member.

The developing rollers 18*a* to 18*d* rotate while making the toner layer contact the surface of the photosensitive drum 1 to develop an electrostatic latent image on the photosensitive drum 1. The developing rollers 18*a* to 18*d* are sequentially moved to a developing position (i.e. a position opposite to the photosensitive drum 1) 14 by the rotation of the retaining member 15.

The revolver developing device 4 stands by at a position where development is executed in the BK developing unit 4*a*, without being in contact with the photosensitive drum 1.

Each of the developing rollers 18*a* to 18*d* is constituted by covering a metal shaft with an elastic body layer of conductive urethane rubber or the like and coating the elastic body layer with a conductive polyurethane coating. A developing bias voltage is applied to the developing rollers 18*a* to 18*d*.

The elastic body layer has a hardness of 30° according to an A-type hardness meter under JIS Standards K6301, and an outer diameter thereof is 18 mm. The electric resistance of the conductive urethane rubber is $4\times10^3$ m as calculated by measuring a current observed when the developing roller is arranged in parallel with a stainless roller having a diameter of 60 mm so as to be in contact therewith in 2 mm and when the potential difference between the metal shafts of both the rollers is set at 100V. Further, the permanent set is 3.8% as measured in a measuring method defined under JISK6310.

Each of the feed rollers 19*a* to 19*d* is constituted by bonding semiconducting foaming urethane around a metal shaft, and has a diameter of 12 mm. The feed rollers 19*a* to 19*d* are arranged to engage in the developing rollers 18*a* to 18*d* in about 0.5 mm, and rotate in an opposite direction to the developing rollers 18*a* to 18*d*.

The toner is conveyed to the vicinity of the developing rollers 18*a* to 18*d* in accordance with the rotation of the feed rollers 19*a* to 19*d*, and is sandwiched between the developing rollers 18*a* to 18*d* and the feed rollers 19*a* to 19*d*. Thus, a part of the toner comes into a sliding contact with the developing rollers 18*a* to 18*d* so as to be slightly electrified by friction, and adhere to the developing rollers 18*a* to 18*d* by an electric field applied between the feed rollers 19*a* to 19*d* and the developing rollers 18*a* to 18*d*.

In the present embodiment, a bias voltage of −250V is applied to the developing rollers 18*a* to 18*d* and a bias voltage of −400V is applied to the feed rollers 19*a* to 19*d*.

The toner which is not electrified by friction is drawn by the toner adhering to the developing rollers 18*a* to 18*d* and adhere to the developing rollers 18*a* to 18*d*.

On the other hand, toner recovery mechanisms 20*a* to 20*d* serving as recovery devices are arranged respectively in the first to fourth blocks 15*a* to 15*d* of the retaining member 15.

The toner recovery mechanisms 20*a* to 20*d* are arranged respectively in intervals of the developing units 4*a* to 4*d*. The toner recovery mechanisms 20*a* to 20*d* are composed respectively of rotary brushes 21*a* to 21*d*, knocking plates 22*a* to 22*d*, and recovery boxes 23*a* to 23*d*.

Each of the rotary brushes 21*a* to 21*d* is a rotary brush formed of semiconducting fibers having an outer diameter of approximately 14 mm, with fiber thickness of 600D/100F and resistance of $10^8$ to $10^9$ cm. The density of fiber transplant is 100KF/inch$^2$. Each of the knocking plates 22*a* to 22*d* is a Mylar plate which is 0.5 mm thick. The rotary brushes 21*a* to 21*d* rotate at a peripheral speed ratio of 0.5 time in an opposite direction to the photosensitive drum 1.

The recovery boxes 23*a* to 23*d* of the toner recovery mechanisms 20*a* to 20*d* are connected respectively to the developing units located on a downstream side in the direction of rotation of the retaining member 15 from the toner recovery mechanisms 20*a* to 20*d*, via recycle valves 24*a* to 24*d*.

For example, the recovery box 23*d* of the toner recovery mechanism 20*d* of the Y developing unit 4*d* is connected to the BK developing unit 4*a* via the recycle valve 24*d*. The toner (black toner) recovered by the toner recovery mechanism 20*d* is fed to the BK developing unit 4*a* on the downstream side in the direction of rotation of the retaining member 15 as described later.

Next, a color image forming operation will be explained.

First, the surface of the photosensitive drum 1 is uniformly electrified by the electrifier 2. An electrostatic latent image is formed on the electrified surface of the photosensitive drum 1 by scanning information light based on image information, which is emitted from the exposure device 3. The exposed image information is monochromatic image information obtained by resolving a desired full-color image into chromatic information of yellow, magenta, cyan and black.

For example, if a black electrostatic latent image (hereinafter called a BK latent image) is formed on the photosensitive drum 1, the developing roller 18*a* is rotated and development is started by BK toner Ta from a top end portion of the BK latent image before the top end portion of the BK latent image arrives at the developing position 14. A back end portion of the BK latent image passes at the developing roller 18*a* and thus a BK toner image is formed. After that, the retaining member 15 of the revolver developing device 4 is rotated quickly, the Y developing unit 4*d* of a next color is moved to the developing position 14, and a Y toner image of a next color is formed in the same manner as the above described manner. After that, an M toner image and a C toner image are sequentially formed in the same manner.

Figure 3:
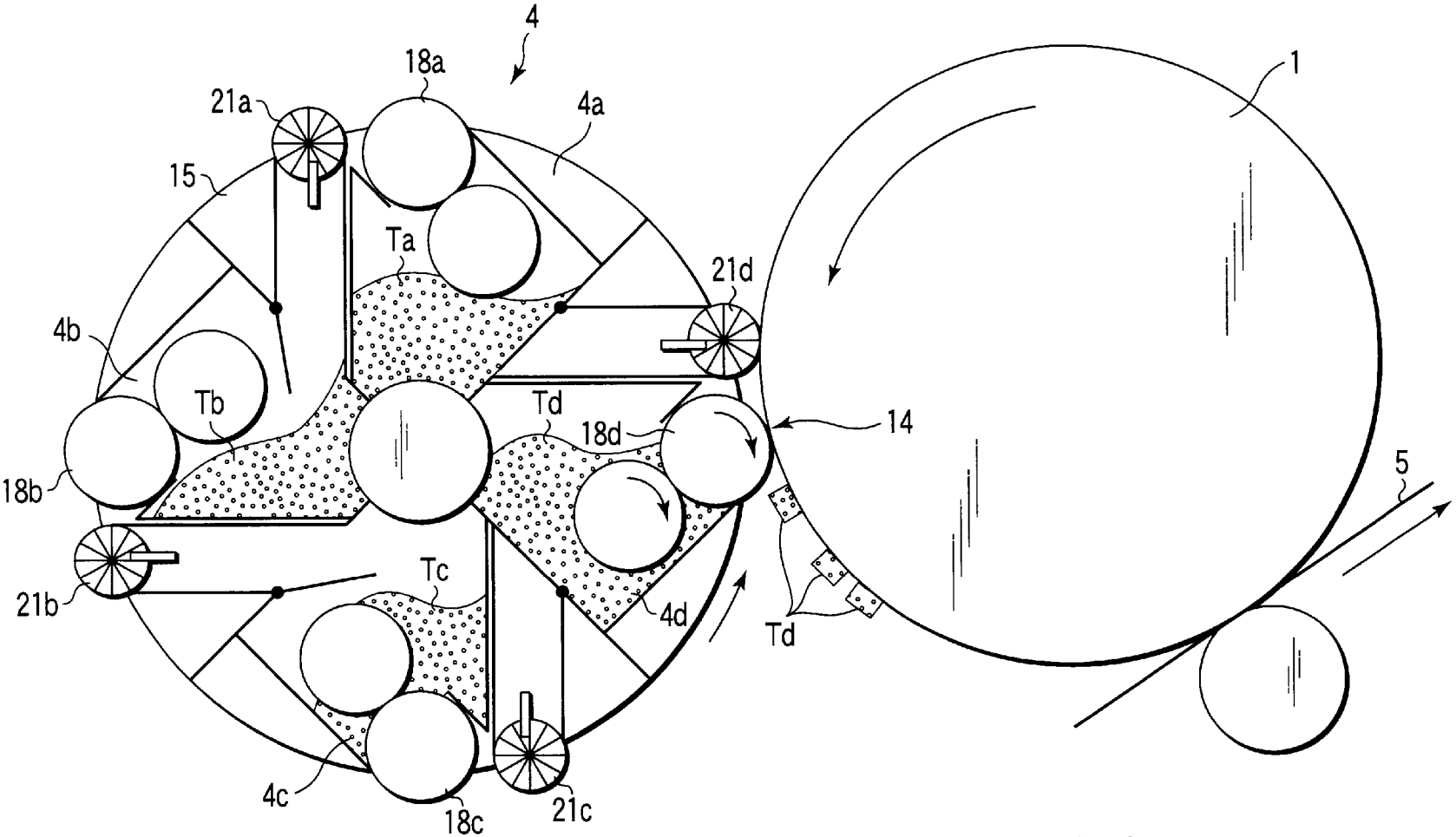
FIG. 3 shows a developing operation of the developing device.
Figure 4:
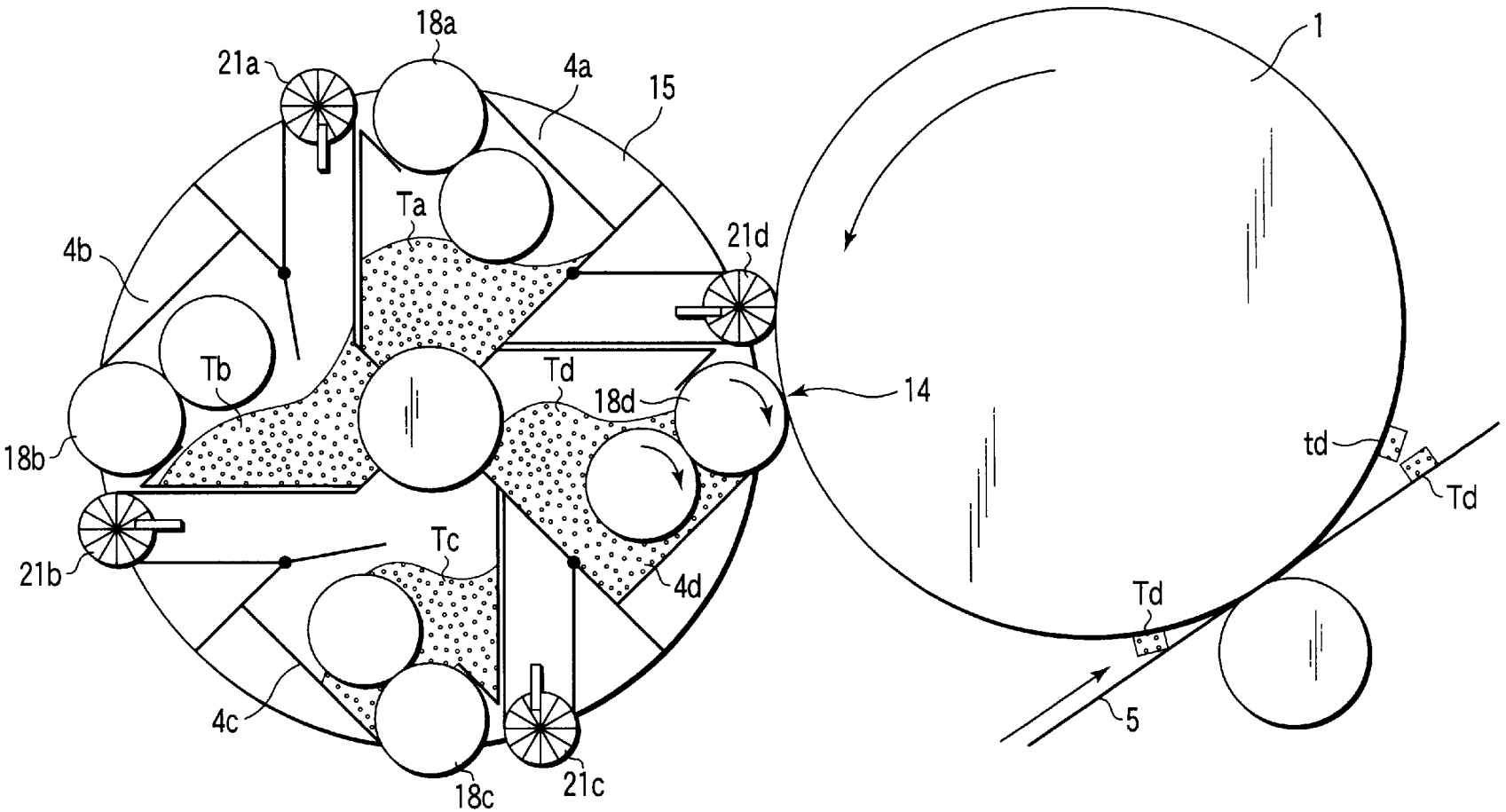
FIG. 4 shows a transferring operation of a developer image.
Figure 5:
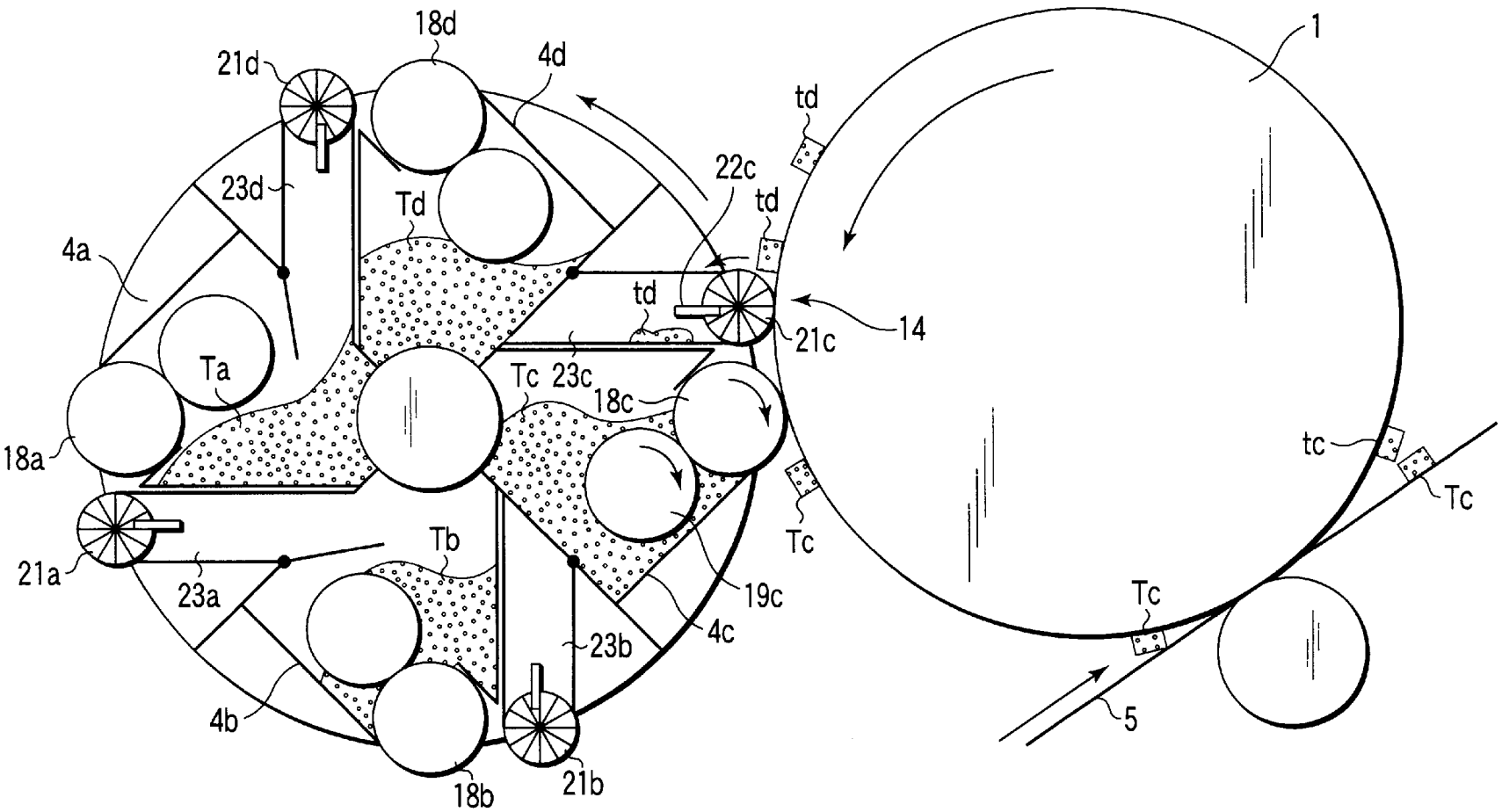
FIG. 5 shows a removing operation of transfer residual toner.

For example, a Y toner image Td is formed on the photosensitive drum 1 and moves toward a primary transfer point of the intermediate transfer belt 5 in accordance with the rotation of the photosensitive drum 1, as shown in FIG. 3. The Y toner image Td is subjected to primary transfer on the intermediate transfer belt 5 at the primary transfer point, as shown in FIG. 4. At this time, transfer residual Y toner td slightly remains on the photosensitive drum 1. The transfer residual Y toner td moves again toward the developing position 14 in accordance with the rotation of the photosensitive drum 1. At this time, the retaining member 15 of the revolver developing device 4 rotates in a counterclockwise direction to make the M developing unit 4*c* face the developing position 14 before a top end of the transfer residual Y toner td reaches the developing position 14, as shown in FIG. 5.

Thus, the transfer residual Y toner td on the photosensitive drum 1 is captured by the rotary brush 21*c* which is in contact with the photosensitive drum 1 on the upstream side in the direction of rotation of the photosensitive drum from the N developing unit 4*c*. The captured Y toner td is knocked down by the knocking plate 22*c* which is positioned on an opposite side to the photosensitive drum 1 and is retained in the recovery box 23*c*.

Figure 6:
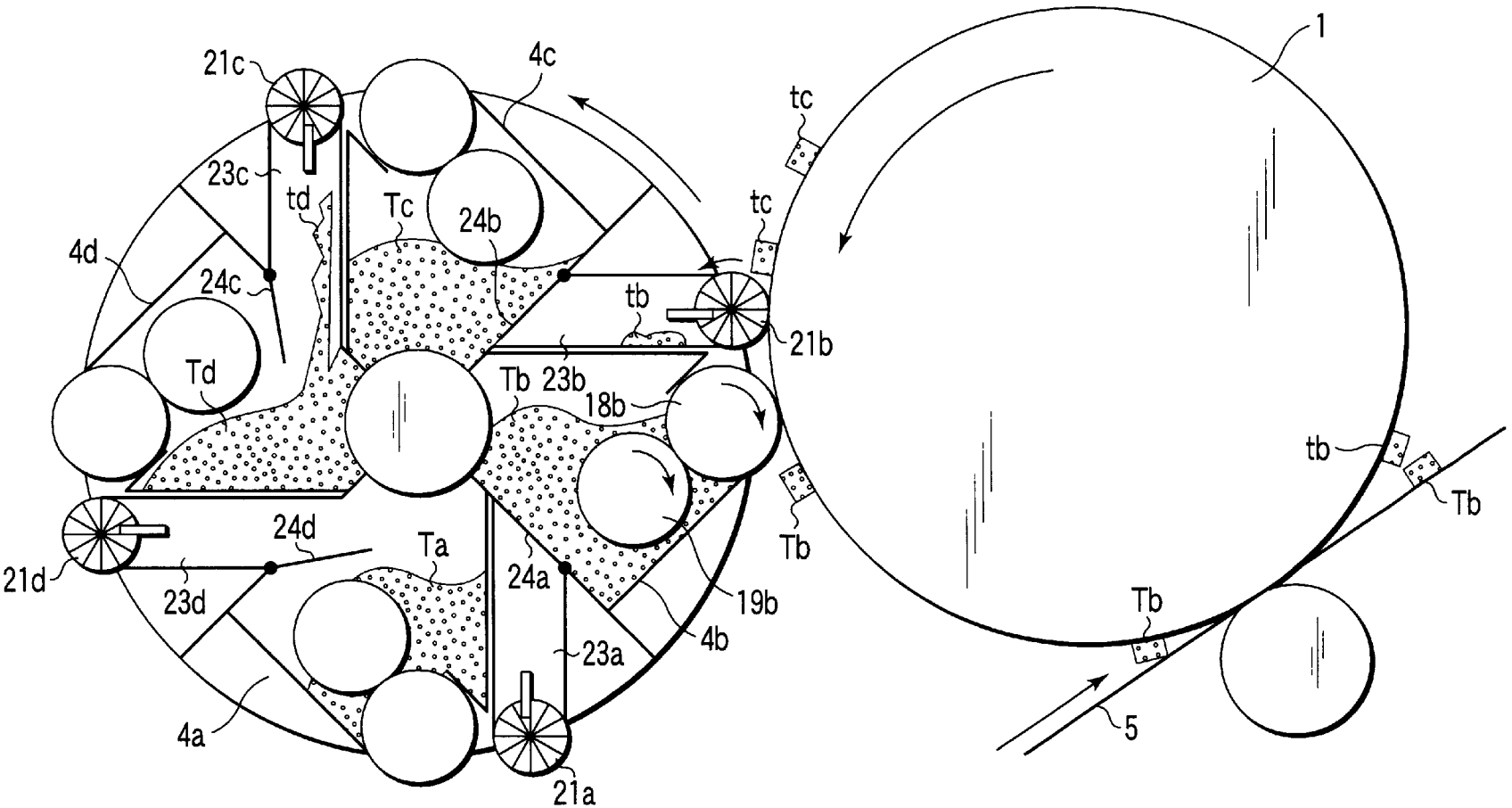
FIG. 6 shows a recovering operation of transfer residual toner.

Further, when the image formation process proceeds and the revolver developing device 4 rotates to make the C developing unit 4*b* move to the developing position, the recovery box 23*c* retaining the previously recovered Y toner td is inclined at 90 degrees such that the retained Y toner td falls by the gravity and returns into the Y developing unit 4*d* through the recycle valve 24*c* which is opened by the gravity, as shown in FIG. 6.

Similarly, transfer residual toner tc, tb and ta of the other colors on the photosensitive drum 1 is retained in the recovery boxes 23*b*, 23*a* and 23*d* to return to the developing units 4*c*, 4*b* and 4*a*.

The toner images of the respective colors formed on the photosensitive drum 1 are superposed and transferred on the intermediate transfer belt 5 rotating in synchronization with the photosensitive drum 1. The toner images superposed on the intermediate transfer belt 5 are transferred together on transfer paper conveyed by the transfer roller 11. After that, the transferred images on the transfer paper are fixed by the fixing rollers 12 to form a full-color image.

As described above, according to this embodiment, as the developing units 4*a* to 4*d* and the recovery mechanisms 20*a* to 20*d* are integrally embedded to the revolver developing device 4, a compact structure can be obtained.

If a full-color image is printed by employing this image forming apparatus, a preferable image can be obtained without waste toner on the photosensitive drum 1.

Figure 7:
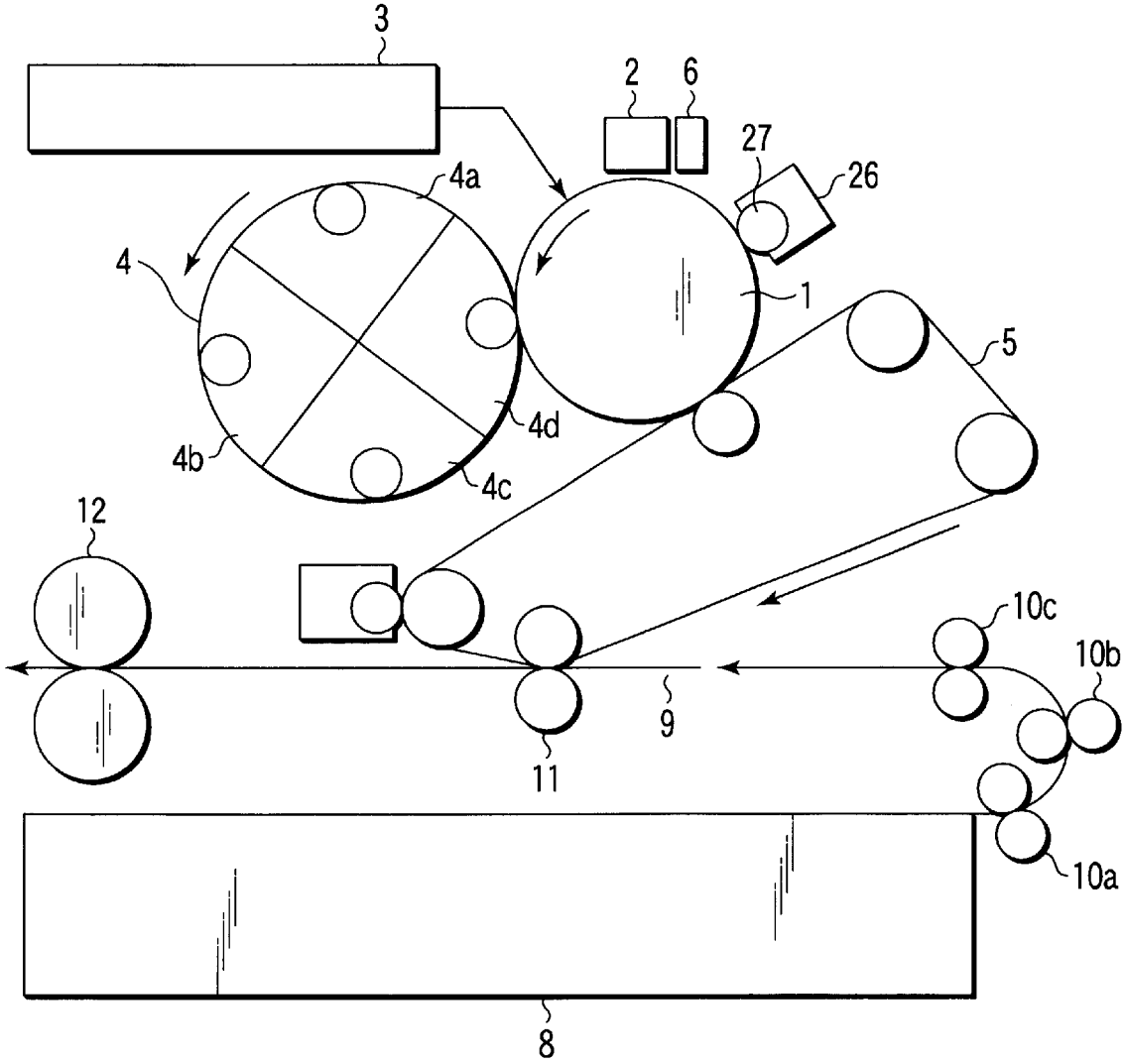
FIG. 7 shows a schematic view of an electrographic copying machine according to a second embodiment of the present invention.

FIG. 7 shows an image forming apparatus according to a second embodiment of the present invention.

The same portions as those of the first embodiment are denoted by the same reference numerals and their explanation is omitted.

In the second embodiment, the toner recovery mechanisms 20*a* to 20*d* shown in the first embodiment are not arranged in the respective blocks 15*a* to 15*d* of the retaining member 15, but a recovery unit 26 is provided as a recovery device on the upstream side in the direction of rotation of the photosensitive drum 1 from the destaticizer 6.

The recovery unit 26 comprises a rotary brush 27. The rotary brush 27 is formed of semiconducting fibers having an outer diameter of approximately 14 mm, with fiber thickness of 600D/100F and resistance of $10^8$ to $10^9$ cm. The density of fiber transplant is 100KF/inch$^2$. The rotary brush 27 rotates at peripheral speed ratio of 0.5 time in an opposite direction to the photosensitive drum 1. A bias of +200V is applied to the rotary brush 27 when the toner is recovered, and a bias of −400V is applied thereto when the toner is fed.

Next, the recovery process of the transfer residual toner according to the second embodiment will be described.

First, for example, an yellow latent image formed on the photosensitive drum 1 in the same image forming process as that of the first embodiment is developed by Y developing unit 4*d*. The developed Y toner image is moved toward the primary transfer point of the intermediate transfer belt 5 in accordance with the rotation of the photosensitive drum 1. The Y toner image is subjected to primary transfer on the intermediate transfer belt 5, at the primary transfer point. At this time, a small amount of transfer residual Y toner remains on the photosensitive drum 1. The transfer residual Y toner is temporarily recovered from the photosensitive drum 1 by the rotation of the rotary brush 27 of the recovery unit 26.

When the development of the Y developing unit 4*d* is ended, the retaining member 15 of the developing device 4 is rotated such that the M developing unit 4*c* faces the photosensitive drum 1. The M toner image developed by the M developing unit 4*c* in the same manner as that described above is transferred to the intermediate transfer belt 5. A small amount of transfer residual M toner remaining on the photosensitive drum 1 is temporarily recovered from the photosensitive drum 1 by the rotation of the rotary brush 27 of the recovery unit 26.

After that, the development is executed in the same manner by the C developing unit 4*b* and the BK developing unit 4*a*, and the C toner and the BK toner remaining on the photosensitive drum 1 are also recovered by the rotation of the rotary brush 27 of the recovery unit 26 after the image transfer. When the development of the BK developing unit 4*a* is ended, the toner which the recovery unit 26 temporarily retains is simultaneously spewed out on the photosensitive drum 1 by biasing the rotary brush 27 at −400V. The spewed toner is recovered by the BK developing unit 4*a*. The recovery of the toner is executed by the BK developing unit 4*a* alone. After that, the rotation of the retaining member 15 of the revolver developing device 4 is driven again to repeat the developing operations starting from the development of the Y developing unit 4*d*.

In the second embodiment, too, the transfer residual toner can be recovered and reused with a compact structure, similarly to the first embodiment.

When a full-color image is printed with this image forming apparatus, a preferable image can be obtained without waste toner on the photosensitive drum 1.

Figure 8:
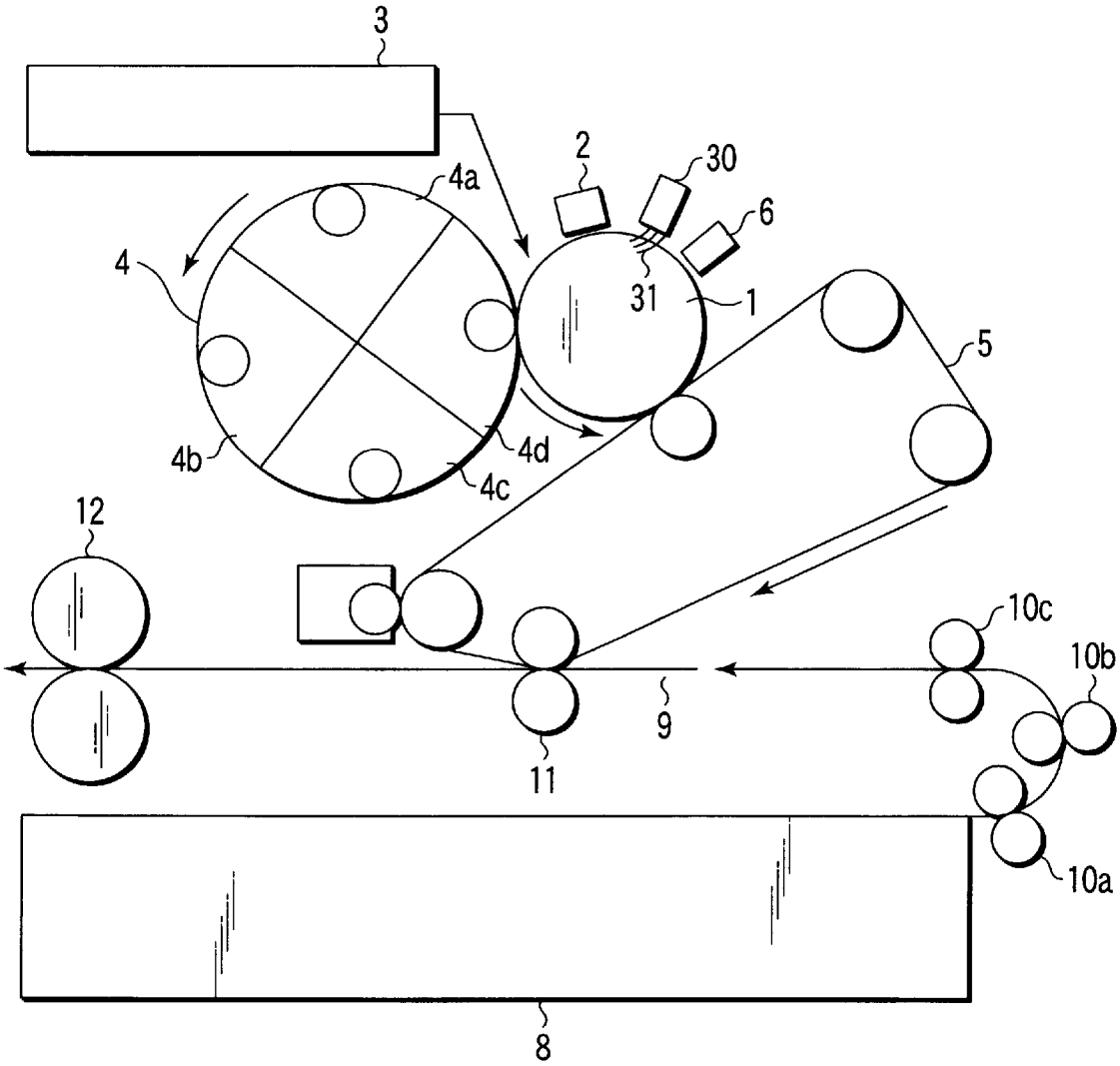
FIG. 8 shows a schematic view of an electrographic copying machine according to a third embodiment of the present invention.

FIG. 8 shows an image forming apparatus according to a third embodiment of the present invention.

The same portions as those of the first embodiment are denoted by the same reference numerals and their explanation is omitted.

In the third embodiment, the toner recovery mechanisms 20*a* to 20*d* are not arranged in the respective blocks 15*a* to 15*d* of the retaining member 15 described in the first embodiment, but a disturbing unit 30 is provided between the destaticizer 6 and the electrifier 2.

The disturbing unit 30 comprises a brush 31 formed by bundling conductive fibers (brand names: Torayca, Kynol, etc.), which are formed by dispersing conductive carbon on fibers of rayon, nylon, or the like having electric resistance of $10^3$ to $10^9$ m, length of 2 to 40 mm, and thickness of 20 to 200 microns, preferably, 20 to 100 microns, at the density of 400 to 500 fibers/cm. The brush 31 contacts the photosensitive drum 1 along a longitudinal direction thereof and also rubs the photosensitive drum 1 in a contact width (nip width) of about 2 to 10 mm in accordance with the rotation of the photosensitive drum 1. A voltage of 0 to +700V, preferably 400 to 600V, is applied.

Next, the recovering process of the transfer residual toner in the third embodiment will be described.

First, for example, a yellow latent image on the photosensitive drum 1, formed in the same image forming process as that described in the first embodiment is developed by the Y developing unit 4*d*. The developed Y toner image is moved toward the primary transfer point of the intermediate transfer belt 5 in accordance with the rotation of the photosensitive drum 1. The Y toner image is subjected to primary transfer on the intermediate transfer belt 5, at the primary transfer point. At this time, toner images which are slightly left and are not transferred or positive and negative electrostatic latent images which are left after toner transfer remain on the photosensitive drum 1. Negative latent images are first erased in these toner images or electrostatic latent images by the destaticizer 6. Then, the images are conveyed to the disturbing unit 30 and subjected to agitation and non-patterning by the brush 31. In the disturbing unit 30, the brush 31 is made to contact the electrostatic latent images such that mechanical and electrostatic forces are applied thereto, and the toner images and electrostatic latent images which remain in an illegible state are finely disturbed. In this case, as the polarity of the toner remaining on the photosensitive drum 1 is initially opposite to the voltage polarity applied to the brush 31, the toner is electrostatically adsorbed to the brush 31, as described above. After a few seconds, however, the polarity of the toner becomes the same and the toner is gradually spewed out again onto the photosensitive drum 1. It is thought that the reversing phenomenon of the toner polarity occurs as the high voltage of +400V is applied to a small gap of 30 to 60 microns at a nip portion and charge injection or discharge occurs to the toner sandwiched between the photosensitive drum 1 and the brush 31.

For this reason, the toner is not captured and accumulated on the brush 31, but the transfer residual toner is always captured and spewed out in a constant cycle. As a result, the only non-patterning function of disturbing residual images and making them illegible acts and the toner can be prevented from accumulating excessively.

The toner in the disturbed region is recovered by the Y developing unit 4*d* when the photosensitive drum 1 is further rotated and the toner reaches again the developing position which faces the Y developing unit 4*d*. In this case, in the electrostatic latent image that is formed at the second time, the residual toner is remarkably reduced in an exposed portion (an image portion where toner should adhere) and a non-exposed portion (a non-image portion) due to the roller transfer. As the residual toner is dispersed in advance, almost uniformly and adequately thinly, by the brush 31, the laser light adequately reaches the photosensitive drum 1 and no exposure irregularity is generated. Accordingly, in the second phenomenon, too, as the residual potential becomes uniform after exposure, uniform results of development can be obtained.

When the development using the Y toner and the recovery of the Y toner are ended, the revolver developing device 4 is rotated for preparation of development using the M toner, the M developing unit 4*b* is moved to the developing position which faces the photosensitive drum 1, and the development using the M toner and the recovery of the M toner are executed. As for the C toner and the BK toner, the development and recovery are executed in the same manner.

Incidentally, a timing of rotating the retaining member 15 of the revolver developing device 4 to move the next developing unit to the developing position is significant. In the monochrome processing, it is insignificant as the toner of the same color is always used. In use of the color toners, however, colors are mixed.

For example, in use of the Y toner, the Y developing unit 4*d* needs to have its position unchanged until a rear end of an image developed with the Y toner returns to the developing position.

Generally, in a process using a cleaner, when the development using the Y toner is ended, the revolver developing device 4 is simultaneously rotated such that the M developing unit 4*c* is arranged at the predetermined developing position.

In a cleaner process of the third embodiment, as it is necessary to wait for formation of an image of a next color during, at least, one rotation of the outer periphery of the photosensitive drum 1, the outer periphery of the intermediate transfer belt 5 where images are superposed and transferred on the latter stage needs to have, at least, sum of the image size and the length of one rotation of the outer periphery.

In addition, it is known from prior art knowledge that the length of the outer periphery of the intermediate transfer belt 5 is preferably an integral multiple of the length of the outer periphery of the photosensitive drum 1, as a condition for preventing misregistration of colors in the superposing and transferring operations. Thus, it can be understood that the following condition is required.

If the outer periphery length of the photosensitive drum 1 is expressed by L1, the outer periphery length of the intermediate transfer belt 5 is expressed by L2, and the maximum length (for example, A3 or ledger) of the paper used in the present image forming apparatus is expressed by L3, conditions L2=n×L1 (n is an integer of 2 or more) and L2−L3≧L1 are required.

Actually, a changing time of the developing units, and the like are required. If a length corresponding to the times is expressed by α, $L2-L3=L1+\alpha$ (α is a length corresponding to the changing time of the developing units and the like)

$L1=(L3+\alpha)/(n-1)$ (n is an integer of 2 or more)

$L2=n\times L1$

For example, if L3=430 mm (ledger) and α=70 mm, L1 and L2 are determined as shown below in TABLE 1.

TABLE 1

| N | L1 mm | L2 mm |
|---|---|---|
| 2 | 530 | 1060 |
| 3 | 265 | 795 |
| 4 | 177 | 708 |
| 5 | 133 | 665 |

TABLE 2

| n | D1 mm | D2 mm |
|---|---|---|
| 2 | 159 | 318 |
| 3 | 80 | 240 |
| 4 | 53 | 212 |
| 5 | 40 | 200 |

TABLE 2 shows values obtained by converting the outer periphery length L1 of the photosensitive drum 1 and the outer periphery length L2 of the intermediate transfer belt 5 into diameters D1 and D2.

In this embodiment, the diameter of the photosensitive drum 1 is set at 80 mm, and the diameter of the intermediate transfer belt 5 is set at 240 mm.

When a full-color image is printed by employing the present image forming apparatus, a preferable image obtained without waste toner on the photosensitive drum 1.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image forming device which separates image information into a plurality of color information items, which scans information light on a rotating image carrier for exposure in accordance with the separated color information items and which sequentially forms electrostatic latent images of respective colors;

developing units of a plurality of colors which sequentially feed developers of the respective colors to the electrostatic latent images of the respective colors formed by the image forming device, at a developing position, to develop the electrostatic latent images;

a rotation member which retains the developing units of the plurality of colors along a rotating direction and which rotates to sequentially move the developing units to the developing position;

an intermediate transfer member which sequentially superposes and transfers the developer images formed on the image carrier and which transfers the superposed and transferred developer images together to an image-transfer member; and a plurality of recovery devices retained on the rotation member, between the developing units of the plurality of colors, to recover developers after the transfer of the developer images to the intermediate transfer member and to make the recovered developers return to the developing units of the same colors as the colors of the developers.

2. An image forming apparatus according to claim 1, wherein the rotation member is divided into a plurality of blocks, one of the developing units and one of the recovery devices are retained in each of the plurality of blocks, and when the developing unit is moved to the developing position the recovery device in the same block as the developing unit is positioned on an upstream side along a direction of the rotation of the image carrier from the developing unit.

3. An image forming apparatus according to claim 2, wherein the recovery device returns the recovered developer to the developing unit retained in the block next to the block where the recovery device is positioned on a downstream side in the direction of the rotation of the rotation member.

4. An image forming apparatus according to claim 3, wherein the recovery device allows the developer recovered in accordance with the rotation of the rotation member to fall by gravitation and returns the developer to the developing unit.

5. An image forming apparatus according to claim 1, wherein each of the recovery devices comprises a rotary brush which removes the developers from the image carrier, a knocking member which knocks down the developers removed by the rotary brush, and a recovery box which recovers the developers knocked down by the knocking member.

6. An image forming apparatus according to claim 1, wherein the developing units of the plurality of colors feed toner of yellow, magenta, cyan and black.

7. An image forming apparatus comprising:

an image forming device which separates image information into color information items of yellow, magenta, cyan and black, which scans information light on a rotating image carrier for exposure in accordance with the separated color information items and which sequentially forms electrostatic latent images of respective colors;

developing units of yellow, magenta, cyan and black which sequentially feed developers of the respective colors to the electrostatic latent images of the respective colors formed by the image forming device, at a developing position, to develop the electrostatic latent images;

a rotation member which retains the developing units of the plurality of colors along a rotating direction and which rotates to sequentially move the developing units to the developing position;

an intermediate transfer member which sequentially superposes and transfers the developer images formed on the image carrier and which transfers the superposed and transferred developer images together to an image-transfer member; and a recovery device which temporarily recovers the developers of the respective colors that are left on the image carrier after the developer images of the respective colors are transferred to the intermediate transfer member, and which returns the recovered developers together onto the image carrier, wherein the developing unit of black is moved to the developing position to recover together the developers of the respective colors returned from the recovery device onto the image carrier.

8. An image forming apparatus comprising:

an image forming device which separates image information into a plurality of color information items, which scans information light on a rotating image carrier for exposure in accordance with the separated color information items and which sequentially forms electrostatic latent images of respective colors;

developing units of a plurality of colors which sequentially feed developers of the respective colors to the electrostatic latent images of the respective colors formed by the image forming device, at a developing position, to develop the electrostatic latent images;

a rotation member which retains the developing units of the plurality of colors along a rotating direction and which rotates to sequentially move the developing units to the developing position; and an intermediate transfer member which sequentially superposes and transfers the developer images formed on the image carrier and which transfers the superposed and transferred developer images together to an image-transfer member, wherein, at the developing position, the developing units develop the electrostatic latent images and recover residual developers that are left on the image carrier when the developer images are transferred from the image carrier to the intermediate transfer member, and wherein the rotation member stops rotation and allows the developing units that develop the electrostatic latent images at the developing position to stand by at the developing position until the developing units recover the residual developers.

9. An image forming apparatus according to claim 8, comprising a disturbing device which disturbs the residual developers that are left on the image carrier.

10. An image forming apparatus according to claim 9, wherein the disturbing device has a brush-like body formed by bundling conductive fibers.

11. An image forming apparatus according to claim 8, wherein $L2=n\times L1$ (n is an integer of 2 or more) and $L2-L3\geqq L1$ where L1 expresses an outer periphery length of the image carrier, L2 expresses an outer periphery length of the intermediate transfer member, and L3 expresses a maximum length of the image-transfer member.

* * * * *